US005975964A

United States Patent [19]

Seko et al.

[11] Patent Number: 5,975,964

[45] Date of Patent: Nov. 2, 1999

[54] FEMALE TERMINAL FITTING

[75] Inventors: Satomi Seko; Masamitsu Chishima; Kenii Okamura; Yoshimasa Wada; Hiroyuki Oka, all of Yokkaichi, Japan

[73] Assignee: Sumitomo Wiring Systems, Ltd., Japan

[21] Appl. No.: 08/898,836

[22] Filed: Jul. 23, 1997

[30] Foreign Application Priority Data

Jul. 25, 1996 [JP] Japan ..... 8-196747

[51] Int. Cl.[6] ..... H01R 13/11

[52] U.S. Cl. ..... 439/857

[58] Field of Search ..... 439/856, 857, 439/851, 852, 745

[56] References Cited

U.S. PATENT DOCUMENTS

| | | | |
|---|---|---|---|
| 3,663,931 | 5/1972 | Brown | 439/857 |
| 4,900,271 | 2/1990 | Colleran et al. | 439/595 |
| 5,246,390 | 9/1993 | Egenolf | 439/839 |
| 5,360,356 | 11/1994 | May et al. | 439/851 |
| 5,362,260 | 11/1994 | Peloza | 439/872 |
| 5,755,599 | 5/1998 | Hotea | 439/851 |

FOREIGN PATENT DOCUMENTS

| | | |
|---|---|---|
| 0 517 076 A2 | 9/1992 | European Pat. Off. . |
| 0 517 077 A2 | 9/1992 | European Pat. Off. . |
| 0 517 139 A2 | 9/1992 | European Pat. Off. . |
| 0 700 124 A2 | 3/1996 | European Pat. Off. . |

*Primary Examiner*—Gary Paumen
*Attorney, Agent, or Firm*—Banner & Witcoff, Ltd.

[57] ABSTRACT

A pair of resilient contacts 12 facing each other are made into a C shape. The base end of each contact 12 connects to a tubular member 11. In this manner, the contact 12 has a strengthening wall 13 formed along the direction of bending. Thus when a male terminal fitting C is inserted between the contacts 12, the strengthening walls 13 bend in a direction that is parallel to the wall face and consequently an increased clamping force can be provided notwithstanding that the thickness of the terminal material is not great. Miniaturization of the terminal is facilitated.

8 Claims, 4 Drawing Sheets

FEMALE TERMINAL FITTING

TECHNICAL FIELD

The present invention relates to a female electrical connector.

BACKGROUND TO THE INVENTION

Female terminal fittings of the type shown in FIGS. 15 and 16 of this specification are well known. This type of female terminal fitting comprises a main body 1 formed by bending from a thin electrically conducting metal plate, and a stainless steel protecting cover 2 that covers the main body 1. The main body 1 is formed so as to have an insertion aperture 3 into which a corresponding male terminal fitting (not shown) is inserted, the insertion aperture 3 being connected to a barrel member 4 which is located posteriorly to the insertion aperture 3 and which allows the connection of an electric wire terminal thereto. The insertion aperture 3 has a pair of resilient contacts 6 formed by extending longitudinal side walls 5 in an anterior direction, the side walls 5 being provided so as to face each other on the left and right sides (the upper and lower sides in FIG. 15). The male terminal fitting is inserted between the resilient contacts 6 and forces them apart.

However, the resilient force of the contacts is determined by the plate thickness of the portion connecting with the side walls, and in the case where this portion is thin, it is not possible to maintain a sufficient contact pressure with respect to the male terminal fitting. In particular, along with the increased desirability of miniaturization of the connector, it becomes necessary to reduce this portion's thickness in correspondence with the plate material thickness of the female terminal fitting. For this reason, it becomes very difficult to maintain a sufficient contact pressure with respect to the male terminal fitting.

The present invention has been developed after taking the above problem into consideration, and aims to provide a female terminal fitting wherein a pair of resilient contacts provided thereon give an increased contact pressure.

SUMMARY OF THE INVENTION

According to the invention there is provided a female terminal fitting having opposed resilient contacts adapted to part and grip a male terminal fitting, and a supporting member supporting the base of each of said contacts, wherein said contacts each further include at least one supporting wall connected to said supporting member, and protruding in the direction of parting of said contacts.

These supporting walls stiffen the contacts in the direction of parting or bending and thus have the effect of increasing the contact pressure on an inserted male terminal. Advantageously the walls can be bent out of the sheet material from which the terminal fitting is made, and thus contributes to miniaturization of the terminal and the use of the minimum sheet thickness commensurate with function.

The contact may bend at the region of attachment to the supporting member, and thus in one embodiment the contacts are stiffened in this area only, for example by one or more slits in the supporting member itself. In this way the contact is partially constituted by the slit region of the supporting member.

A tubular supporting member is preferred for reasons of strength and integrity. The contacts may be further stiffened by indentations pressed in the surface thereof, preferably adjacent the root or base of each contact.

The contacts may themselves have contacting members pressed in or sheared out of one face thereof, and in the preferred embodiment these contacting members are constituted by opposite substantially parallel slits.

A protective cover is preferably provided to add strength to the terminal and to protect the relatively deformable contacts from accidental damage. The cover is preferably tubular so as to surround the terminal on all sides.

BRIEF DESCRIPTION OF THE DRAWINGS

Other features of the invention will be apparent from the accompanying description of several preferred embodiments shown by way of example only in the accompanying drawings, in which.

DESCRIPTION OF THE PREFERRED EMBODIMENTS

A first embodiment of the present invention is explained hereinbelow, with reference to FIGS. 1 to 6.

Figure 1:
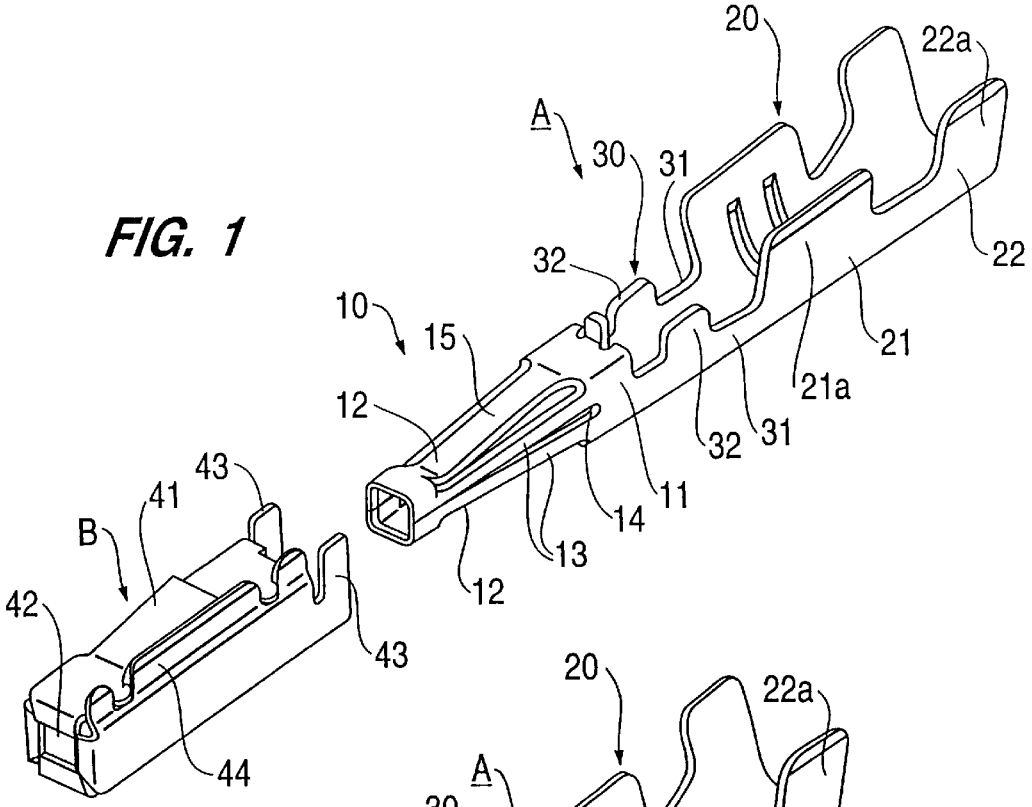
FIG. 1 is a diagonal view of a disassembled first embodiment of the invention.
Figure 2:
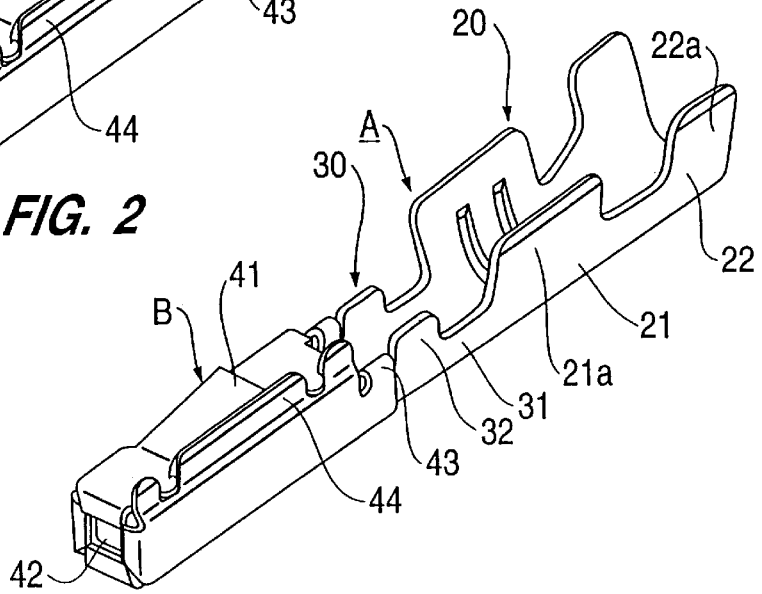
FIG. 2 is a diagonal view of the first embodiment with the protecting cover attached.

As shown in FIG. 1, a female terminal fitting comprises a terminal main body A made from electrically conducting sheet metal (for example, a thin copper alloy) that has been bent, and a protecting cover B that covers the terminal main body A; the protecting cover is for example of a stronger material, such as stainless steel.

The main body A is configured so as to be provided with an insertion member 10 into which a corresponding male terminal fitting C (see FIG. 5) is inserted, and a barrel member 20 connected to the insertion member 10 via a connecting member 30, the terminal of an electric wire being connected by crimping thereto. The barrel member 20 comprises a wire barrel 21 that crimps a core wire of an electric wire, and an insulation barrel 22 connecting to the posterior side of the wire barrel 21 that crimps a covered portion of the core wire. The barrels 21 and 22 have a conventional shape whereby they protrude upwards as crimping members 21*a* and 22*a*.

Figure 3:
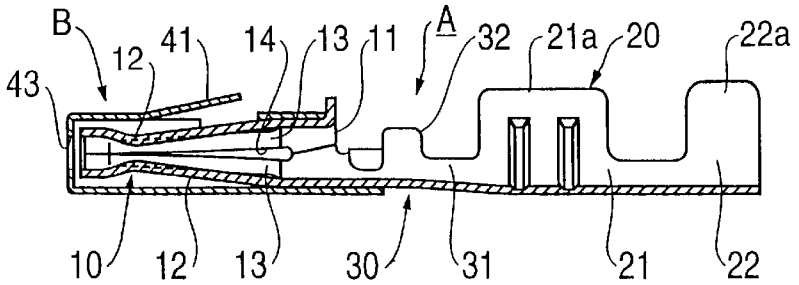
FIG. 3 is a cross-sectional view through the first embodiment.

The insertion member 10 has an angled tubular shape that narrows off towards the anterior end, and, as shown in FIG. 3, the insertion member 10 has a partition extending from the anterior end towards the posterior end, the partition dividing the aperture 10 into an upper and lower part. Thus, the posterior end has a tubular member 11 forming an angled tubular shape, and the anterior end has resilient contacts 12 which are channel-shaped when seen cross-sectionally. The contacts 12 are formed so as to be connected and to face each other in an up-down direction. This tubular member 11 constitutes a supporting member of the present invention, and, the left and right edge members of the contacts 12 comprise resilient strengthening walls 13. As shown in FIG. 3, a slit 14 is provided between the strengthening walls 13 located above and below, the slit 14 extending from approximately the centre with respect to the lengthwise direction up to the tubular member 11, and gradually widening as it proceeds towards the tubular member 11 where its posterior end has a rounded shape.

Figure 4:
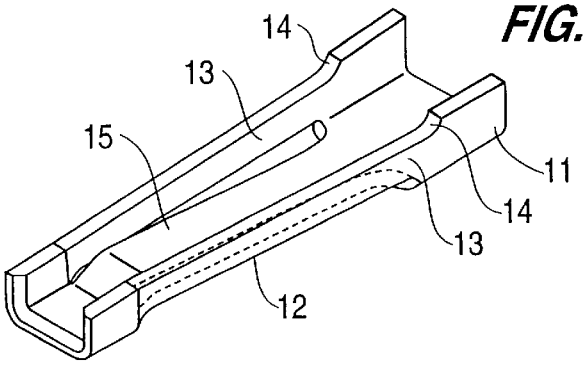
FIG. 4 is a partially enlarged diagonal view showing an elastic contact of the first embodiment.

In the roof face and the base face of the insertion member 10, a contacting member 15 is formed so as to protrude inwards. As shown in FIG. 4, the contacting members 15 are cut away in a parallel manner along the longitudinal direction of the left and right sides of roof face and the base face, the inner side of the contacting member 15 protruding towards the interior of the insertion member 10 by being bent inwards. The location of the protrusion is closer to the anterior side of the contacting member 15.

The connecting member 30 is in the form of a groove facing side walls 31 on the left and right sides having a pair of stabilizers 32 protruding in an upward direction.

As shown in the left side of FIG. 1, the protecting cover B is formed by bending a stainless steel thin metal plate into an angular tubular shape, its lengthwise dimension being slightly larger than the length of the insertion member 10, and its inner diameter being slightly larger than the outer diameter of the tubular member 11. In other words, the protecting cover B has a bending space provided to allow the bending of the elastic contacts 12 with respect to the insertion member 10 and is insertable from the anterior end so as to cover the space.

A The upper face of the protecting cover B has a lance 41 formed by cutting away so as to extend outwards from the anterior end. The right side wall of the protecting cover B (the more proximately located side wall in FIG. 1) protrudes slightly higher than the upper face, thereby constituting a protecting wall 44. The bending space of the lance 41 is within the protecting wall 44. At the anterior end of the protecting cover B an opening edge is bent inwards, and a through hole 42 formed for allowing the male terminal fitting C to pass through. The posterior end of the protecting cover B has a pair of fixed members 43 protruding therefrom. When the protecting cover B is over the insertion member 10, these fixed members 43 overlap the side walls 31 of the connecting member 30 from the exterior. By bending the fixed members 43 inwards, the protecting cover B is retained (see FIG. 2).

Figure 6:
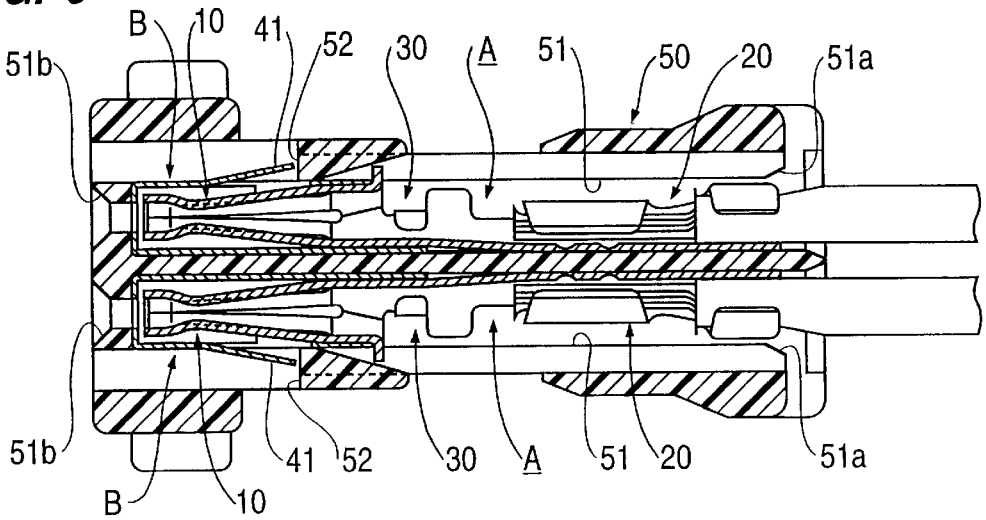
FIG. 6 is a cross-sectional view from the side showing the first embodiment in an attached state in a connector housing.

FIG. 6 shows the female terminal fitting attached to a connector housing 50. This connector housing 50 has cavities 51 aligned in the sideways direction thereof. The posterior end of each cavity 51 has a terminal attachment hole 51*a* for attaching the female terminal fitting, and the anterior end thereof has a terminal insertion hole 51*b* for inserting the male terminal fitting C. Furthermore, stopping members 52 are formed by cutting away inner wall faces on the outer side of the cavities 51. A lance 41 of the female terminal fitting fits with the stopping member 52 when the female terminal fitting is attached to the cavity 51 via the terminal attachment hole 51*a*. Thus, the female terminal fittings are attached with their bases facing each other.

Next, the operation of the present embodiment is explained. After each of the terminal fittings is attached to the connector housing 50, the male and female connectors are fitted together and the male terminal fitting C is inserted into the through hole 42 of the protecting cover B via the terminal insertion hole 51*b* of the connector housing 50, and furthermore is inserted into the insertion member 10 of the terminal main body A. The male terminal fitting C which has entered the insertion member 10 enters between the contacts 12 and parts the contacting members 15.

Figure 5:
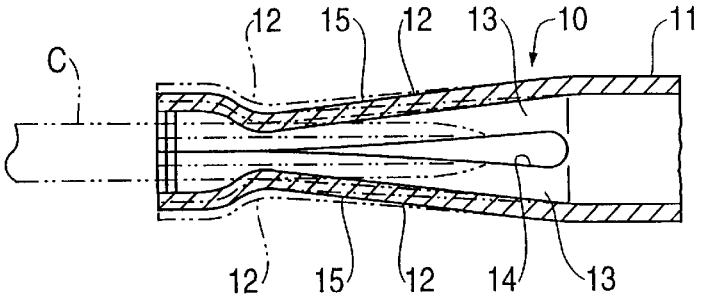
FIG. 5 is a partially enlarged cross-sectional view showing male terminal fitting in an inserted state in the first embodiment.

Along with this, the contacts 12 widen by changing shape so as to bend in an up-down direction from the root portion (see FIG. 5). At this stage, the contacts 12 force the bending of those portions of the elastic strengthening walls 13 which connect with the tubular members 11, the bending occurring along the direction of the wall face (the up-down direction in FIG. 5). Consequently, a resilient force corresponding to that of the strengthening wall 13 applies on the portion having the wall 13 provided thereon, thereby resulting in an increase in the force applying to the contacts 12. The male terminal fitting C is thus strongly clamped by the contacts 12.

In this manner, in the present embodiment, the following results are achieved by connecting the strengthening wall 13 extending from the base ends of the elastic contacts 12 to the tubular member 11.

(1) By providing the strengthening wall 13, the resilient force of the contacts 12 increases, and accordingly, the contacting force with respect to the male terminal fitting C can be increased.

(2) Since the supporting member (the tubular member 11), which connects with the base end of the strengthening wall 13, is made into a tubular shape, it is difficult for this portion to change shape and bend in accompaniment with the change in shape of the wall 13; thus the contact pressure can be increased with certainty.

(3) As a result, since the contacting force with respect to the male terminal fitting C can be increased without increasing the thickness of the plate material, this configuration is particularly effective in the case where the terminal fitting is to be miniaturized.

(4) Since the contacting members 15 protrude from the facing faces in the contacts 12, the male terminal fitting C makes contact with certainty with the contacts 12, thereby maintaining a conducting state with certainty. Moreover, since the contacting members 15 have been formed by shearing and bending, the contacting members 15 make a more certain contact with the male terminal fitting C.

(5) The force applying on the contact 12 by the insertion of the male terminal fitting C can be distributed to the base portion of the contact 12 and the strengthening wall 13, thereby reducing the malformation of the contacts 12 due to prolonged use, the life thereof thus increasing.

(6) Since the protecting cover B is attached into the insertion member 10, an accidental change in shape of the contacts 12 due to an external forces can be prevented.

Figure 7:
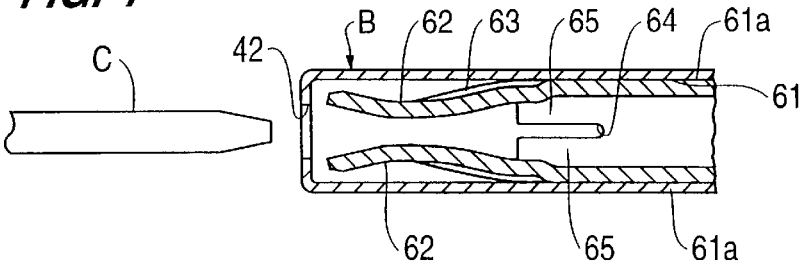
FIG. 7 is a diagonal view of a disassembled second embodiment.
Figure 8:
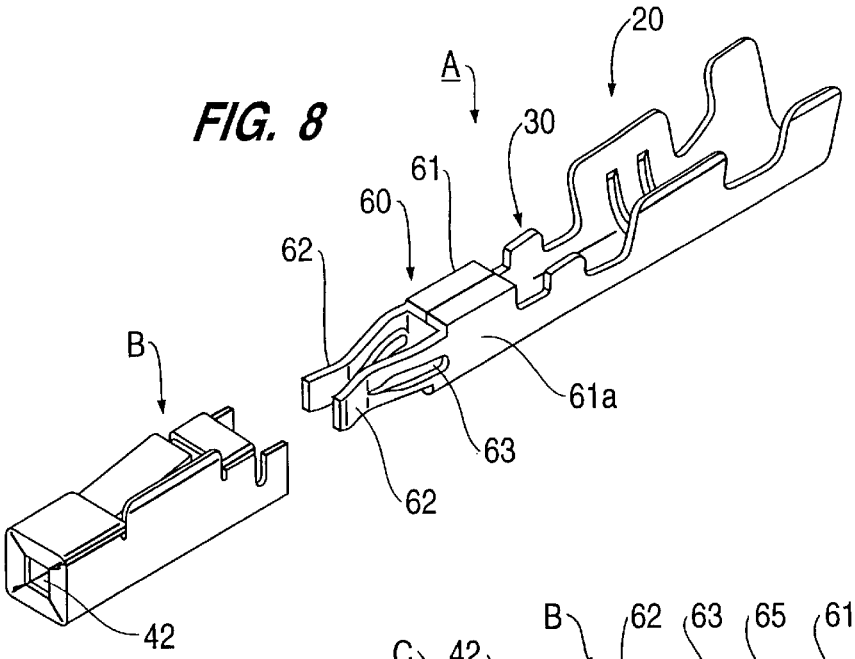
FIG. 8 is a partially enlarged cross-sectional view showing an insertion member of the second embodiment.
Figure 9:
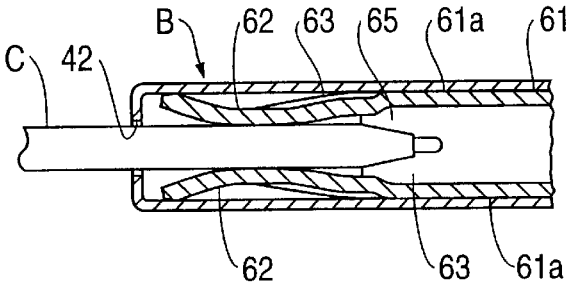
FIG. 9 is a partially enlarged cross-sectional view showing a male terminal fitting in an inserted state in the second embodiment.

A second embodiment of the female terminal fitting of the present invention is explained with the aid of FIGS. 7 to 9. In this second embodiment, the configuration of the insertion member is different from that of the first embodiment. Since the barrel member, the protecting member, and the other parts are the same as in the first embodiment, the same numbers are accorded to parts having the same configuration as in the first embodiment, and an explanation thereof omitted.

As shown in FIG. 7, an insertion member 60 has a tubular member 61 located at the posterior end (the end connecting with a connecting member 30), resilient contacts 62 protruding anteriorly from left and right side walls 61*a*. The contacts 62 are curved inwards, and accordingly, the space between the contacts 62 decreases in a portion closer to the anterior end, and then increases as the anterior end is approached. Furthermore, the external side walls connecting the base of the contacts 62 to the left and right side walls 61*a* of the tubular member 61 have pressed deformations 63 which are formed so as to extend inwards. These deformations 63 are approximately arc-shaped and become gradually narrow in the direction of their anterior ends. In addition, as shown in FIG. 8, between the contacts 62 a slit 64 is formed having a fixed depth that extends in an interior direction from an anterior edge of the base plate of the tubular member 61. The tubular member 61 corresponds to the supporting member of the present invention, and by forming the slit 64 on the base plate of the tubular member, the portions extending from the lower edge of the base end of the contact 62 up to the tubular member 61 correspond to strengthening walls 65.

When a male terminal fitting C enters the insertion member 60 via a through hole 42 of the protecting cover B, as in the case of the first embodiment, the male terminal fitting C pushes against and widens the contacts 62 into the interior. The contacts 62 change shape and bend so as to part, but since the strengthening walls 65 are formed on the base end portion of the contacts 62, these are also made to bend in a direction that goes along the wall faces. Furthermore, since the base end of the contacts 62 have the deformations 63 formed thereon, it is difficult for the base end to bend. Consequently, the resilience of the contact 62 is increased, and the male terminal fitting C is strongly gripped (see FIG. 9).

In this manner, by connecting the strengthening wall 65 to the tubular member 61, effects similar to the first embodiment are achieved, such as increasing the contact pressure with respect to the male terminal fitting C. Moreover, in the present embodiment, by providing the inward extending deformations 63 on the outer side faces of the contacts 62, the root portion of the contacts 62 is further strengthened, thereby increasing resilient force.

A third embodiment of the female terminal fitting of the present invention is explained with the aid of FIGS. 10 to 13. In this embodiment, the configuration of the insertion member is arranged to different from that of the first embodiment. Since the barrel member, the protecting member, and the other parts are the same as in the first embodiment, the same numbers are accorded to parts having the same configuration as in the first embodiment, and an explanation thereof omitted.

Figure 10:
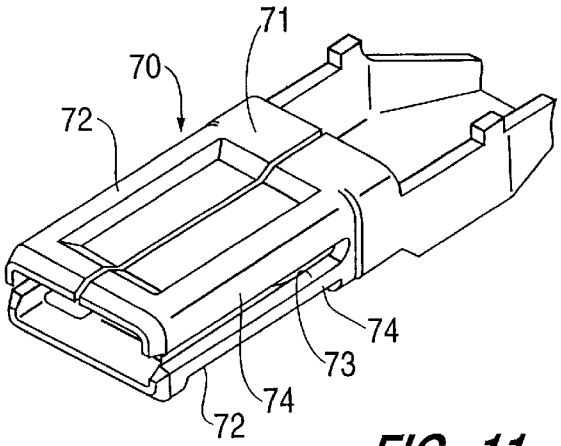
FIG. 10 is a diagonal view showing an insertion member of a third embodiment.

As shown in FIG. 10, an insertion member 70 of the present embodiment forms more of a square tubular shape in a sideways direction compared to the insertion member of the first embodiment, slits 73 being formed so as to extend from anterior ends of the left and right side wall faces approximately up to a base member. Accordingly, as in the case of the first embodiment, a tubular member 71 is formed in the base member, and a pair of resilient contacts 72 are formed in a connected manner so as to face each other in an up-down direction on the anterior ends of the tubular members 71. Here, the bent portion provided on the left and right edges of the contacts 72 constitutes a strengthening wall 74, and this wall 74 is connected to the tubular member 71, which constitutes a supporting member.

Figure 11:
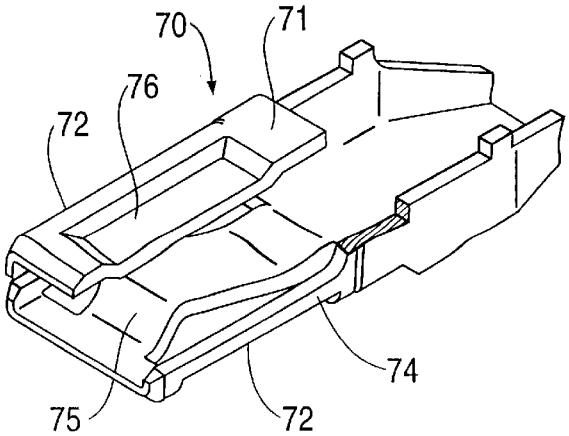
FIG. 11 is a partially cut-away diagonal view showing the contacting member of the third embodiment.
Figure 12:
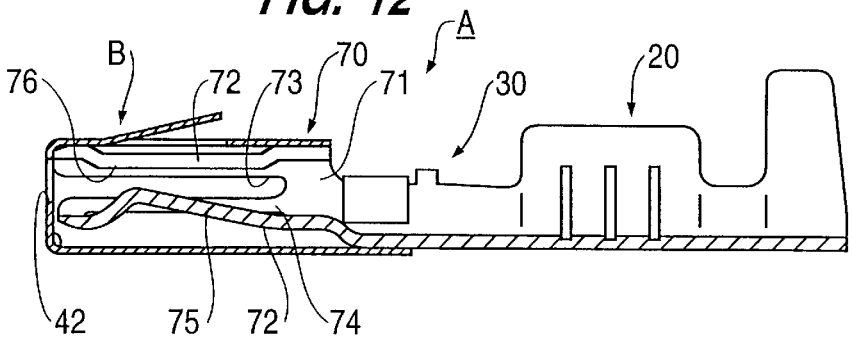
FIG. 12 is a cross-sectional view from the side of the third embodiment.
Figure 13:
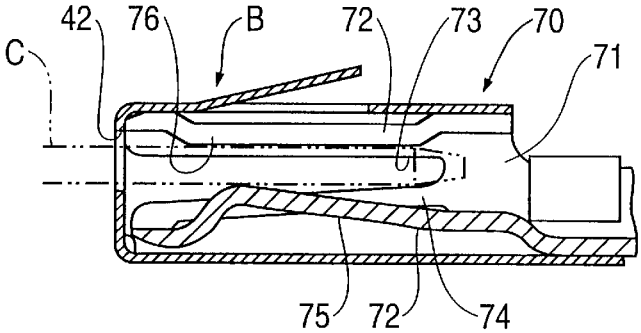
FIG. 13 is a partially enlarged cross-sectional view of the third embodiment showing a state whereby the male terminal fitting is in an inserted state.

As shown in FIGS. 11 and 12, the inner portion of the insertion member 70 has a contacting member 75 formed therein by cutting away and pushing inwards the base face of the insertion member 70. That is, the contacting member 75 is formed by shearing along the left and right-hand sides in the lengthwise direction of the base face of the contact 72 located on the lower side, and by making the inner portion of the cut-away member protrude inwards. Furthermore, the ceiling face of the insertion member 70, that is, approximately the entire surface of the ceiling face of the contact 72 has a recessed member 76 formed in a rectangular shape by pressing in from the outer side.

When a female connector having a female terminal fitting attached thereto is fixed to a male connector, the male terminal fitting C enters the insertion hole 70 via the through hole 42 of the protecting cover B, as in the case of the first embodiment. When this is done, the male terminal fitting C fits with the recessed member 76 and pushes the contacting member 75 downwards. As the contacting member 75 bends elastically and changes shape, the contact 72 bends downward, bending the strengthening wall 74 with it. Consequently, the force of the contact 72 is stronger to the extent of the force imparted by the wall 74, the male terminal fitting C inserted between these contacts 72 being strongly gripped (see FIG. 13).

In this manner, in the present embodiment as well, by connecting the strengthening wall 74 with the tubular member 71, effects such as increased contact pressure with respect to the male terminal fitting C are achieved, as in the case of the first embodiment. The terminal 70 is conveniently folded from sheet material with the abutting edges lying across the recessed member 76.

Furthermore, the present invention is not limited to the embodiments described above with the aid of figures. For example, the possibilities described below also lie within the technical range of the present invention.

(1) In the above embodiments, the protecting cover B is formed to be separate and is arranged to be attached to the insertion member 10. However, it may equally be arranged so that the protecting cover is formed in a unified manner with the insertion member. Moreover, the configuration may equally be such that the protecting cover is not attached at all.

(2) In the first embodiment described above, the contacts 12 are made to be facing each other in an up-down direction, but they may equally be arranged to face each other in a sideways direction. Furthermore, the contacts may equally be four in number and may be arranged to face each other in up-down and left-right directions.

(3) In the first embodiment, although it was arranged so that the contacting member 15 is cut away from the facing faces of the contacts 12, it may equally be arranged so that the contacting member is formed by pressing in or the like.

(4) In the second embodiment, although the protruding member 63 is provided in the base portion of the elastic contact 62, it may equally not be provided thereon.

(5) In the second embodiment, although, by forming the slits 64 on the base plate of the tubular member 61, the strengthening walls 65 are formed on the lower edge of the base portion of the contact 62, it may equally be arranged so that slits are formed on the ceiling part of the tubular member, forming a strengthening wall on the upper edge of the base end of the contact. Furthermore, it may equally be arranged that slits are formed on both the base plate and the ceiling plate of the tubular member, and strengthening walls are formed on both the contacts.

Figure 14:
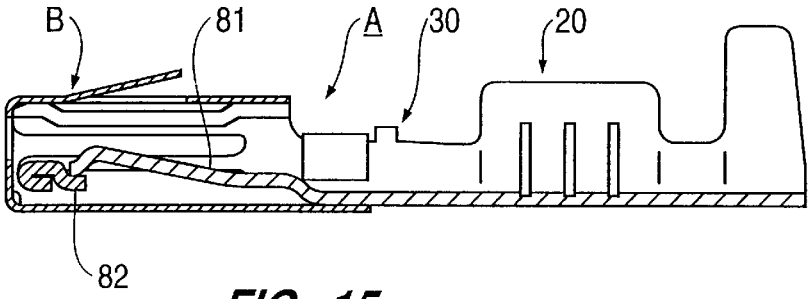
FIG. 14 is a cross-sectional view from the side showing a fourth embodiment of the present invention.
Figure 15:
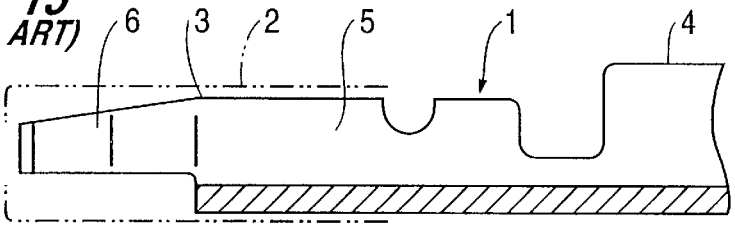
FIG. 15 (PRIOR ART)
FIG. 15 is a cross-sectional view from the side of a prior art female terminal fitting.
Figure 16:
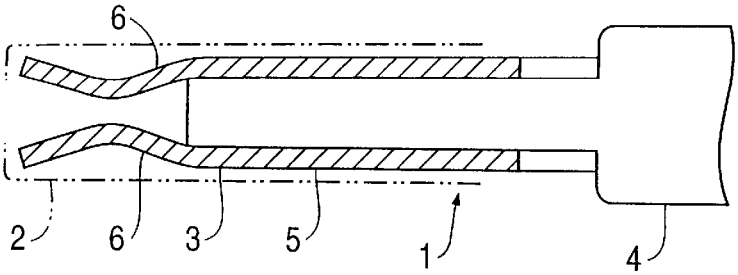
FIG. 16 (PRIOR ART)
FIG. 16 is a plane cross-sectional view through the prior art female terminal fitting.

(6) In the third embodiment, although the left and right sides of the base face of the contacting member have parallel cuts formed thereon and their inner portions pushed in, the configuration may equally be as shown in FIG. 14. That is, the anterior side of the base face is cut away, and the anterior end of a cut-away member 81 is slightly bent downwards. Furthermore, a receiving member 82 is formed by turning over inwards the base plate from its anterior end. The anterior end of the cut-away member 81 being made to make contact with this receiving member 82.

(7) In the third embodiment, the contacting member 75 may equally be arranged to be pressed-out from the base face. In addition, the present invention may be embodied in various other ways without deviating from the scope of the claims attached hereto.

We claim:

1. A female terminal fitting having opposed resilient contacts adapted to move apart and to grip a male terminal fitting, said contacts each having a base and an outer end, and a supporting member supporting the base of each of said contacts, wherein said contacts each further include a supporting wall along each side connected to said supporting member, and wherein each said supporting wall is connected to the base and the outer end of the respective contact and protrudes in the direction of parting movement of said contacts.

2. A terminal according to claim 1 characterized in that said supporting member is tubular.

3. A terminal according to claim 2 characterized in that said supporting walls are partially defined by one or more slits in said supporting member.

4. A terminal according to claim 1 characterized in that said supporting member is tubular, and said contacts are 'U' shaped in section and include edge portions, wherein the edge portions of opposing contacts face each other and constitute said supporting walls, and wherein mid-portions of the contacts have contacting members protruding therefrom.

5. A terminal according to claim 4 characterized in that the contact are sheared out of said mid-portions.

6. A terminal according to claim 1 wherein said contacts have inward bulges adjacent the outer ends thereof.

7. A terminal according to claim 1 and further including a protecting cover for enclosing said contacts.

8. A terminal according to claim 7 characterized in that said cover is tubular.

* * * * *